US009493172B2

(12) United States Patent
McLaughlin et al.

(10) Patent No.: US 9,493,172 B2
(45) Date of Patent: Nov. 15, 2016

(54) OUTLET GATE ASSEMBLY FOR HOPPER CARS

(71) Applicant: Salco Products, Inc., Lemont, IL (US)

(72) Inventors: James M. McLaughlin, New Lenox, IL (US); David A. Oestermeyer, Downers Grove, IL (US); Alex V. Degutis, LaGrange Park, IL (US); Joshua J. Chesser, Lockport, IL (US); Clayton J. Strand, Downers Grove, IL (US); Matthew C. Huang, Lisle, IL (US); William R. Borowski, Palos Park, IL (US)

(73) Assignee: SALCO PRODUCTS INC., Lemont, IL (US)

( * ) Notice: Subject to any disclaimer, the term of this patent is extended or adjusted under 35 U.S.C. 154(b) by 286 days.

(21) Appl. No.: 14/208,730

(22) Filed: Mar. 13, 2014

(65) Prior Publication Data

US 2014/0261070 A1 Sep. 18, 2014

Related U.S. Application Data

(60) Provisional application No. 61/793,806, filed on Mar. 15, 2013.

(51) Int. Cl.

| | |
|---|---|
| ***B61D 7/16*** | (2006.01) |
| ***B61D 7/02*** | (2006.01) |
| ***B61D 7/28*** | (2006.01) |
| ***B61D 7/30*** | (2006.01) |

(52) U.S. Cl.

CPC . *B61D 7/16* (2013.01); *B61D 7/02* (2013.01); *B61D 7/28* (2013.01); *B61D 7/30* (2013.01)

(58) Field of Classification Search

CPC ..... B65G 53/40; B65G 53/42; B65G 53/50; B65G 53/58; B61D 7/00; B61D 7/02; B61D 7/32

See application file for complete search history.

(56) References Cited

U.S. PATENT DOCUMENTS

| | | | | |
|---|---|---|---|---|
| 2,190,727 | A * | 2/1940 | McKenna | B65G 53/42 105/247 |
| 2,418,302 | A * | 4/1947 | Hornbrook | B65G 53/42 406/145 |
| 3,527,503 | A * | 9/1970 | Mundinger | B65G 53/06 406/129 |
| 3,797,891 | A | 3/1974 | Fritz | |
| 4,018,484 | A * | 4/1977 | Dugge | B65G 53/52 138/109 |
| 4,027,921 | A * | 6/1977 | Adler | B65G 53/40 406/130 |
| 4,902,173 | A | 2/1990 | Hendee et al. | |
| 5,232,315 | A * | 8/1993 | Dugge | B65G 53/42 105/247 |
| 5,387,058 | A * | 2/1995 | Smoot | B65G 53/42 280/43.23 |
| 5,575,595 | A * | 11/1996 | Smoot | B65G 53/42 406/118 |
| 6,357,361 | B2 | 3/2002 | Dohr | |
| 6,666,627 | B1 * | 12/2003 | Wysong | B65G 53/4641 222/368 |
| 2003/0206776 | A1 * | 11/2003 | Pearson | B60P 1/60 406/122 |

* cited by examiner

*Primary Examiner* — Zachary Kuhfuss
(74) *Attorney, Agent, or Firm* — Leydig, Voit & Mayer, Ltd.

(57) ABSTRACT

An outlet gate assembly with a body, a discharge conduit having opposite ends defining discharge openings, an air flow conduit having an air flow opening adjacent each of the discharge openings and removable covers, each enclosing one of the discharge openings, and the adjacent air flow opening of the air flow conduit. The covers define a flow path between the discharge opening and adjacent air flow opening. In another form the air flow conduit from each air flow opening comprises a separate tube. Also a cover is disclosed for the discharge tube of an outlet gate for a railroad car that is vented to atmosphere.

13 Claims, 9 Drawing Sheets

OUTLET GATE ASSEMBLY FOR HOPPER CARS

CROSS REFERENCE TO RELATED APPLICATION

This application claims priority pursuant to Title 35 USC §119(e) to U.S. Provisional Application No. 61/793,806 filed Mar. 15, 2013, entitled "Outlet Gate Assembly for Hopper Cars," the entire contents of which are hereby incorporated by reference herein as if fully set forth.

TECHNICAL FIELD

This disclosure relates generally to outlet gate assemblies used on railroad hopper cars, and, more particularly, to an outlet gate assembly having an improved air supply system.

Railroad hopper cars are used to transport material or bulk lading through railway systems. A railroad hopper car typically includes discharge or outlet gate assemblies located on the underside of the car for unloading the transported materials. The outlet gate assemblies typically include one or more valves that may be selectively moved between open and closed positions to permit the material to flow through the opening.

When transporting lading such as granular or particulate matter including, for example, plastic pellets, vacuum discharge systems are often used to unload the hopper cars. The outlet gate assemblies used with vacuum discharge systems typically include a discharge tube positioned beneath the valve and that extends between opposite sides of the outlet gate assembly. Such gates are illustrated in U.S. Pat. Nos. 3,797,891, 4,902,173 and 6,357,361.

During transport, covers are typically installed on outlet tubes on the ends of the discharge tube. During unloading using a vacuum discharge system, the covers are removed from both sides of the discharge tube so that air may flow in one end of the discharge tube as product is removed through the other end of the discharge tube.

A hose from the vacuum discharge system is connected to one end of the discharge tube and the valve of the outlet gate assembly is opened and material falls from the car through an opening in the valve assembly into the discharge tube. A vacuum is applied to the hose and air is drawn into the opposite end of the discharge tube and both material from the car and air from the opposite end of the discharge tube is drawn through the hose and transported to a desired location.

In order to unload material from a hopper car using a vacuum discharge system, both sides of the outlet gate assembly, and thus the hopper car, must be accessed in order to remove the covers from both ends of the discharge tube. If the covers are not removed from both ends of the discharge tube, the vacuum discharge system will not operate properly. However, to remove the cover from the far side or far end of the discharge tube, an operator must either walk around a series of railroad cars or climb over or under the railroad cars. Walking around the railroad cars is time consuming and climbing over or under the railroad cars is dangerous. Accordingly, it would be desirable to provide an outlet gate assembly that permits unloading with a vacuum discharge system in which access to only one side of the outlet gate assembly is required. Such an advantage is provided by the outlet gate of this disclosure.

SUMMARY OF THE DISCLOSURE

In accordance with the disclosure an outlet gate assembly is provided with a body, a discharge conduit having opposite ends defining discharge openings, an air flow conduit having an air flow opening adjacent each of the discharge openings and removable covers, each enclosing one of the discharge openings, and the adjacent air flow opening of the air flow conduit. The covers define a flow path between the discharge opening and adjacent air flow opening. In another form the air flow conduit from each air flow opening comprises a separate tube. Also a cover is disclosed for the discharge tube of an outlet gate for a railroad car that is vented to atmosphere.

The foregoing background discussion is intended solely to aid the reader. It is not intended to limit the innovations described herein, nor to limit or expand the prior art discussed. Thus, the foregoing discussion should not be taken to indicate that any particular element of a prior system is unsuitable for use with the innovations described herein, nor is it intended to indicate that any element is essential in implementing the innovations described herein. The implementations and application of the innovations described herein are defined by the appended claims.

DETAILED DESCRIPTION OF ILLUSTRATED EMBODIMENTS

Figure 1:
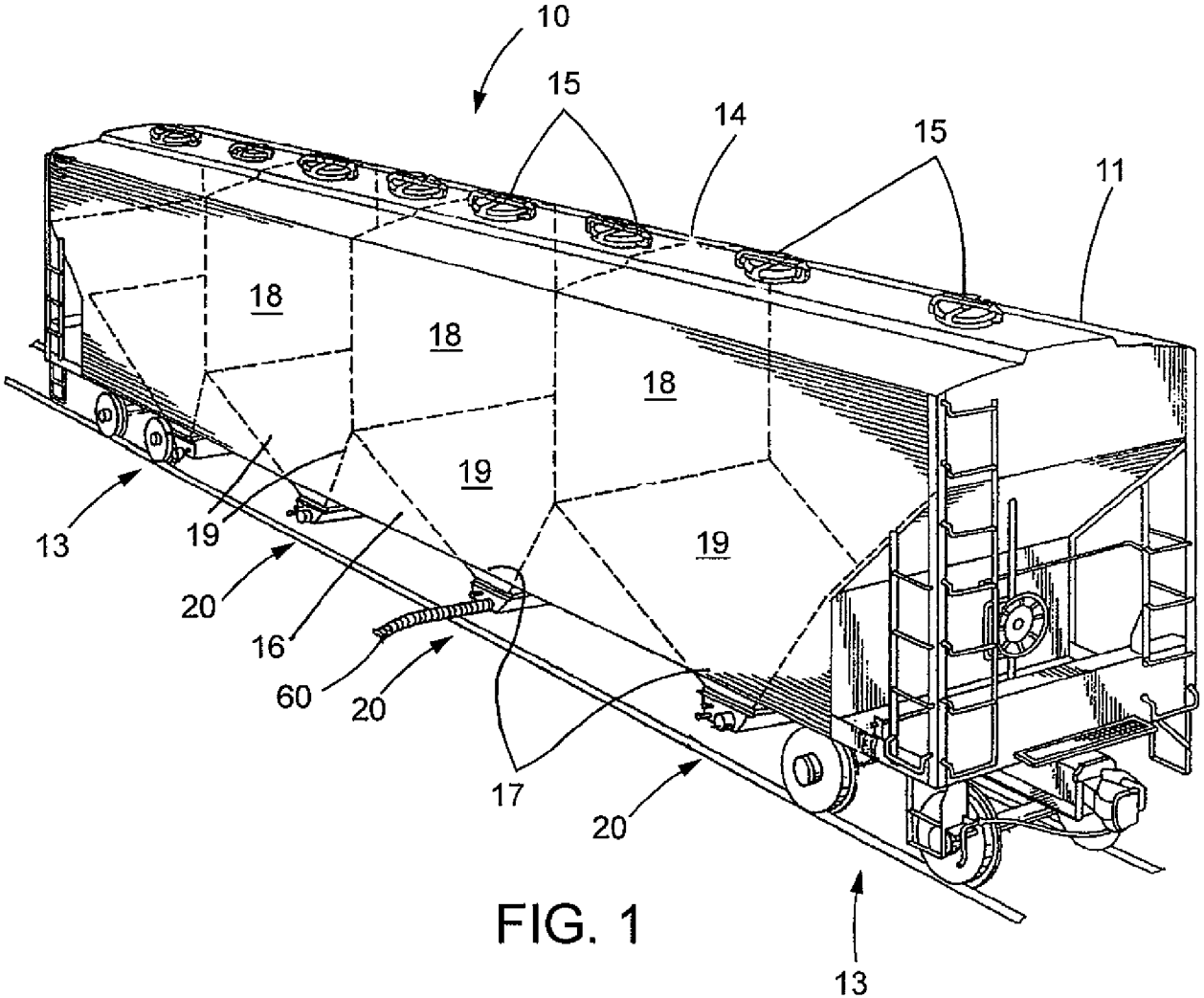
FIG. 1 is a perspective view of railroad hopper car including a plurality of outlet gate assemblies according to the present disclosure.
Figure 2:
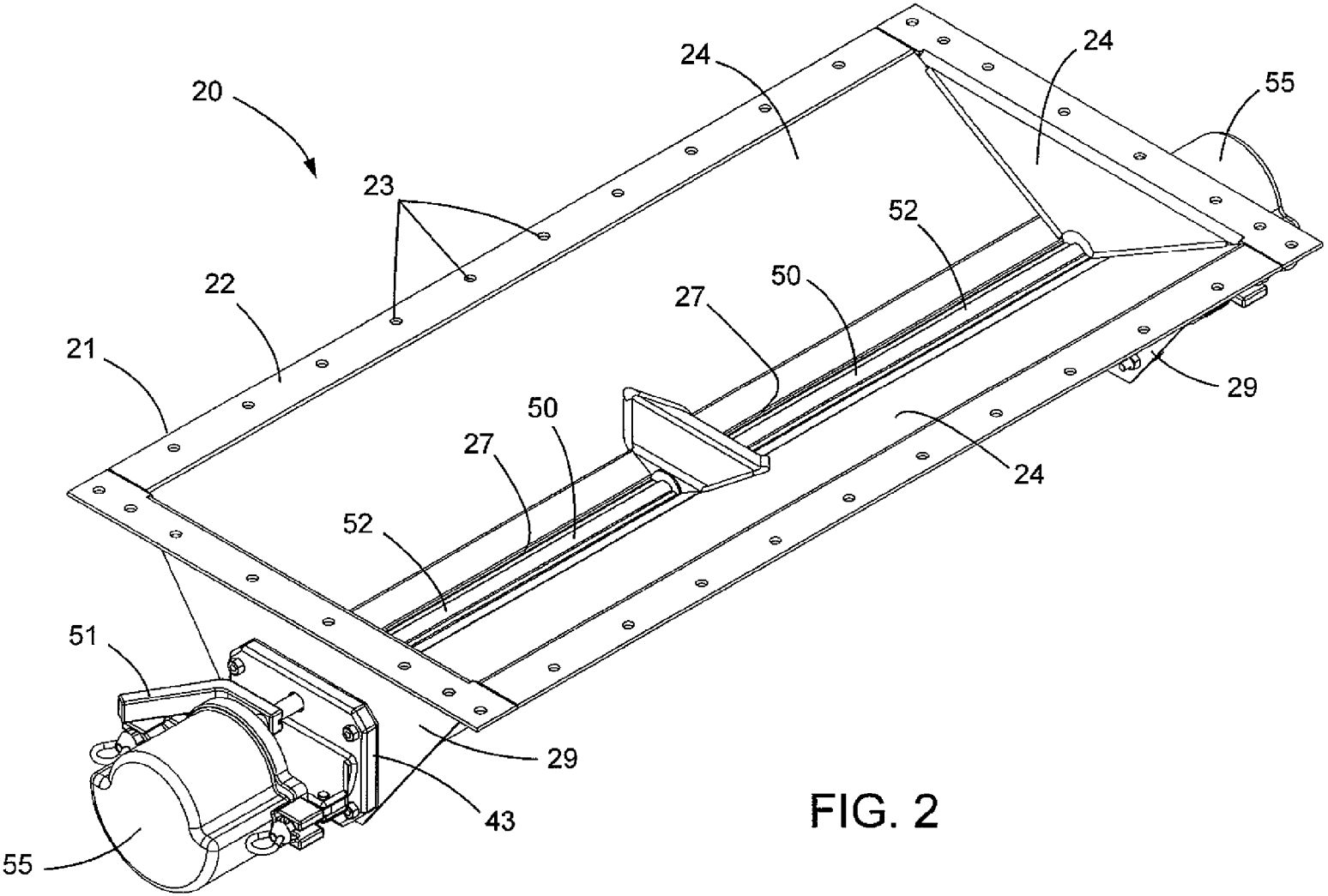
FIG. 2 is a perspective view of an outlet gate assembly of the present disclosure.
Figure 3:
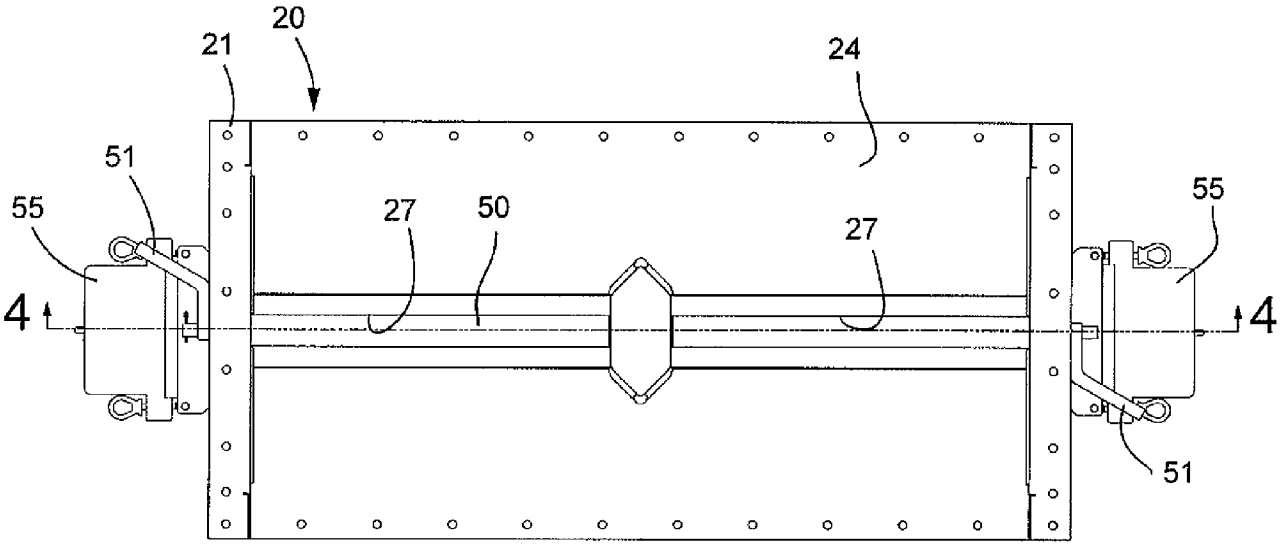
FIG. 3 is a top view of the outlet gate assembly of FIG. 2.
Figure 4:
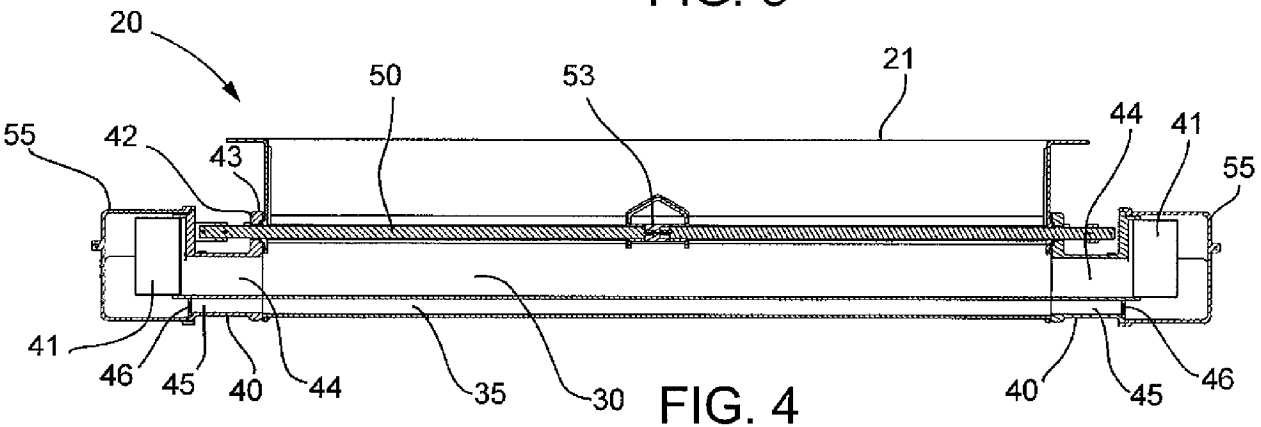
FIG. 4 is a sectional side view of the outlet gate assembly of FIG. 2 taken along the line 4-4 of FIG. 3.
Figure 5:
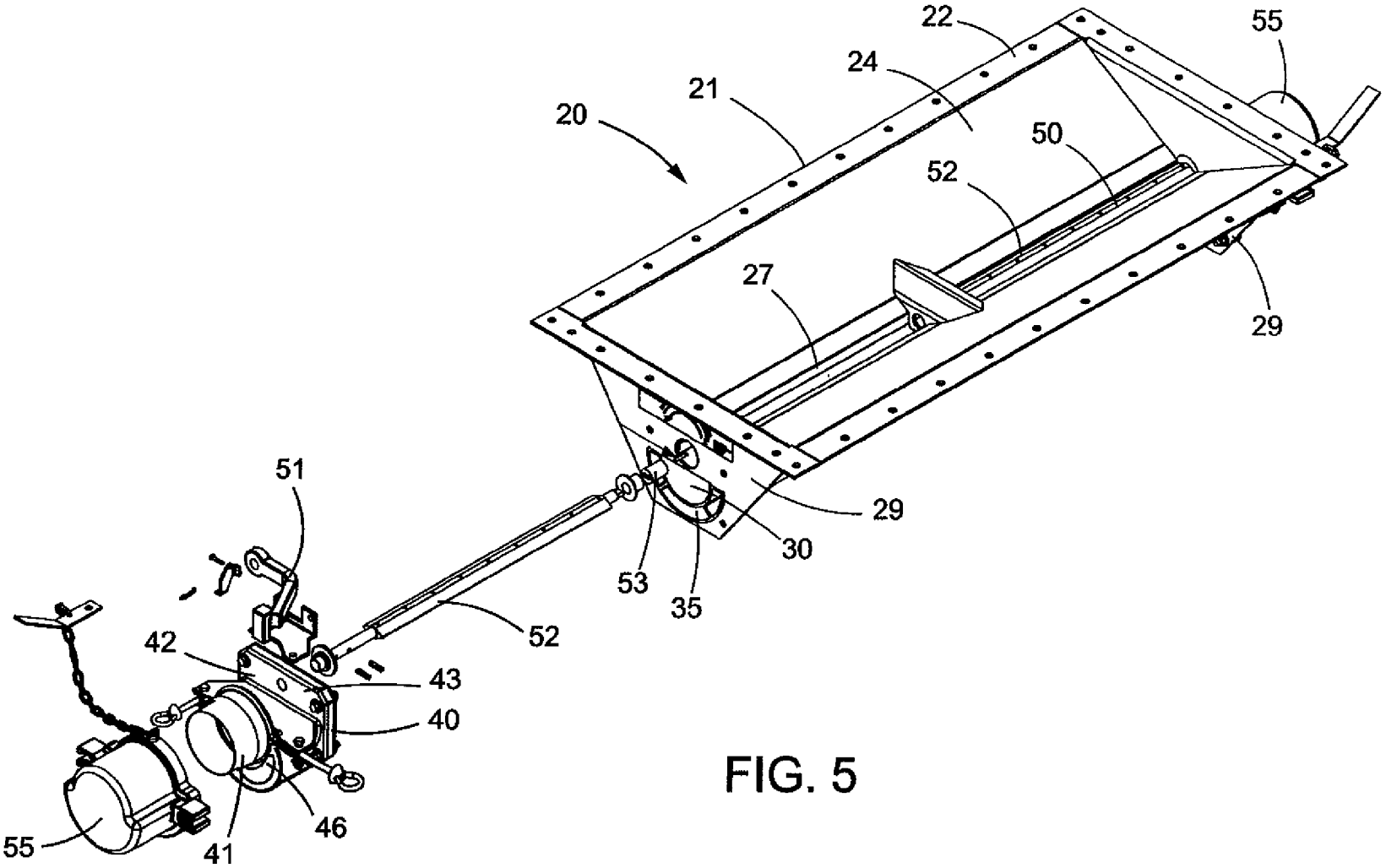
FIG. 5 is an exploded perspective view of the outlet gate assembly of FIG. 2 illustrating features of the discharge valve.

A covered railroad hopper car 10, equipped with a plurality of gate assemblies according to the present disclosure is depicted in FIG. 1. The railroad hopper car 10 may include a multi-walled enclosure 11 for storing and transporting lading in the form of granular or particulate materials such as plastic pellets and other materials therein. The multi-walled enclosure 11 is supported by wheeled trucks, generally designated 13 at opposite ends thereof.

The upper portion 14 of the enclosure 11 may have a plurality of hatch openings (not shown) with hatch covers 15 that may be opened to permit material to be loaded into the enclosure and to permit air flow during unloading. Alternately, the hatch covers 15 may be vented to facilitate air flow without opening the hatch covers. The lower portion 16 of the enclosure 11 is provided with a plurality of openings 17 for facilitating the discharge of materials from within the enclosure 11. The enclosure 11 may include a plurality of separate compartments or hoppers 18 with sloped walls or surfaces 19 funneling downwardly toward each opening 17 in the lower portion 16 of the hopper car 10 to promote the discharge of materials therefrom. An outlet gate assembly, generally designated 20, is elongate, transverse to the length of the car 10 and is aligned with each opening 17 along the lower portion 16 of the hopper car 10 to control the flow of material from the hopper car.

Referring to FIGS. 2-5, an embodiment outlet gate assembly 20 in accordance with this disclosure is depicted in greater detail. Outlet gate assembly 20 has a body 21 configured to be secured to the hopper car 10 through generally rectangular flange 22 at an upper surface thereof. Generally rectangular flange 22 may have a plurality of spaced apart holes 23 through which fasteners such as bolts (not shown) may pass to secure the outlet gate assembly 20 to the hopper car 10. Sloped sidewalls 24 slope downward and inward from the inner edges of flange 22 to form a generally funnel-like structure. The sloped sidewalls 24 guide material from the hopper car 10 through a valve opening 27 and into a generally cylindrical trough-like discharge tube 30. The discharge tube 30 may have other shapes and configurations as desired.

As depicted, the discharge tube 30 is elongate and extends between transverse end walls 29 of the outlet gate assembly 20. A rotatable valve 50 may be mounted on the outlet gate assembly 20 with a handle 51 on each end thereof to facilitate opening and closing of the valve. As depicted, rotatable valve 50 is formed with two separate shafts 52 with a coupling 53 between the two shafts. Upon opening the valve 50, material may flow due to gravity past the sloped sidewalls 24 of the gate 20, through valve opening 27, and into discharge tube 30. Upon closing the rotatable valve 50, material within the hopper car 10 will be retained within the enclosure 11 of the hopper car.

In accordance with the present disclosure, and referring to FIGS. 4, 5, 7, and 8, a separate air flow tube 35 extends generally parallel to the discharge tube 30 and provides a separate path for air flow to assist in removing the material from the hopper car 10 as described in further detail below. In the embodiment depicted in FIGS. 2-8, the air flow tube 35 extends between the opposite transverse end walls 29 of the outlet gate assembly 20 and has a crescent or semi-annular cross-section that is concentric with the discharge tube 30. Other shapes and configurations of air flow tube 35 are contemplated and are not a critical feature.

An end adapter 40 is mounted on each end wall 29 of the outlet gate assembly 20. The end adapter 40 includes a cylindrical outlet tube 41 defining a discharge opening and a body section 42. The cylindrical outlet tube 41 is configured to permit a vacuum hose 60 (FIG. 1) to be attached to an end of cylindrical outlet tube 41 over its discharge opening, when unloading the hopper car 20. The body section 42 includes a flange or bracket 43, a material flow section or passage 44 (FIG. 4), and an air flow section 45 with an air flow opening 46.

The bracket 43 is configured to facilitate mounting an end adapter 40 on each end wall 29 of the outlet gate assembly 20. The material flow section 44 is generally aligned with and connects the cylindrical outlet tube 41 and the discharge tube 30. Accordingly, material flowing through the discharge tube 30 passes through the material flow section 44 of body section 42 before exiting through cylindrical outlet tube 41.

The air flow section 45 and air flow opening 46 of the end adapter 40 are generally aligned with and connect the air flow tube 35 of outlet gate assembly 20 with a source of air such as ambient air. A filter or filter assembly (not shown) may be positioned at the air flow opening 46 to prevent entrained foreign objects or materials from the air flow opening and prevent possible contamination of the material as it exits the hopper car 10.

An outlet tube cover 55 is removably positioned on body section 42 overlying the discharge opening of outlet tube 41 of each end adapter 40 to close the discharge tube 30 at each end of outlet gate assembly 20. In addition, the discharge opening of cylindrical outlet tube 41 and the air flow opening 46 of outlet end adapter 40 are sufficiently adjacent each other that the removable cover 55 also closes the air flow opening 46 of the end adapter 40. In this regard, the term "close" means to isolate from the surrounding atmosphere.

Figure 6:
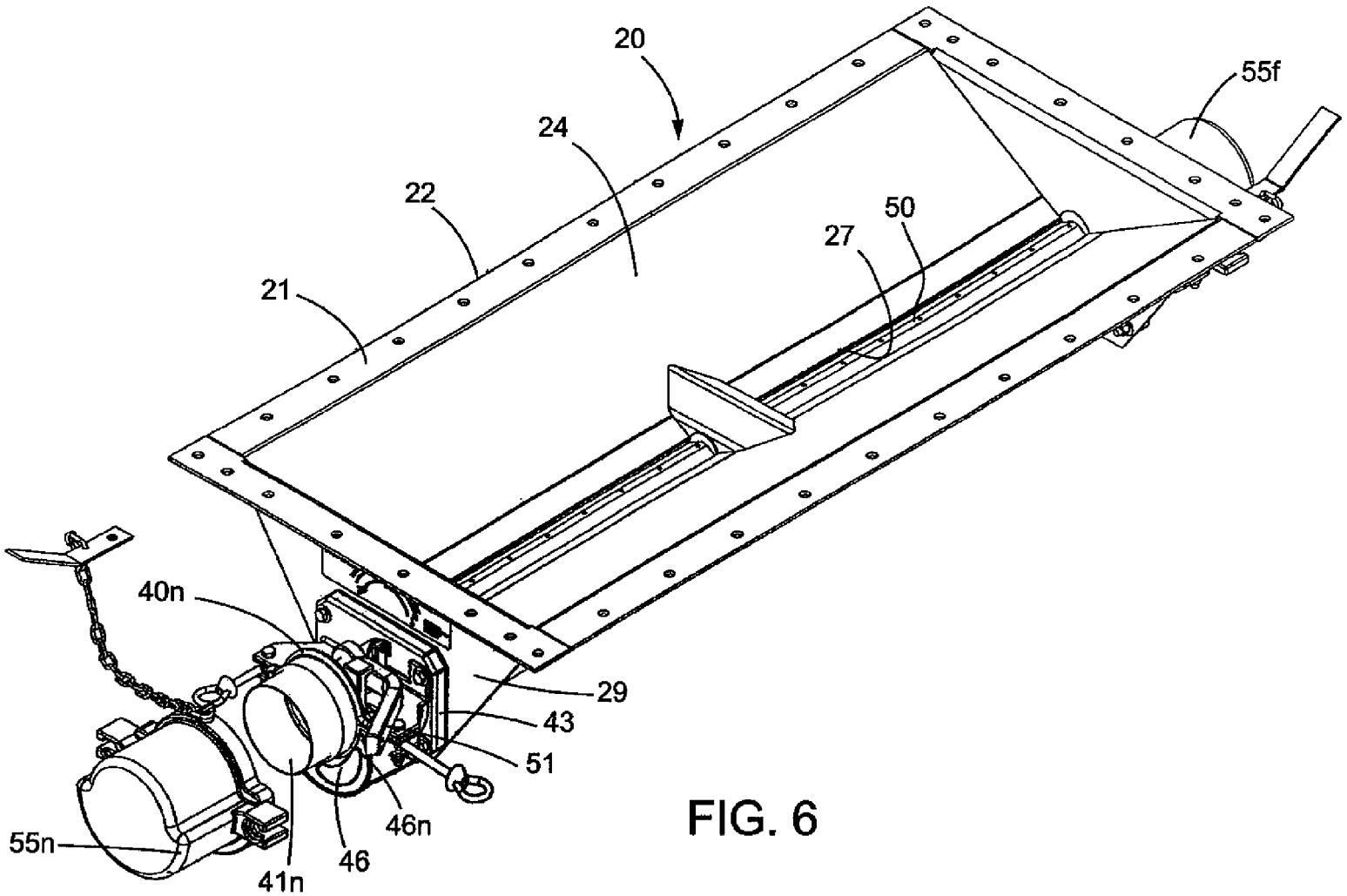
FIG. 6 is a perspective view of the outlet gate assembly of FIG. 2 showing certain components in different positions.
Figure 7:
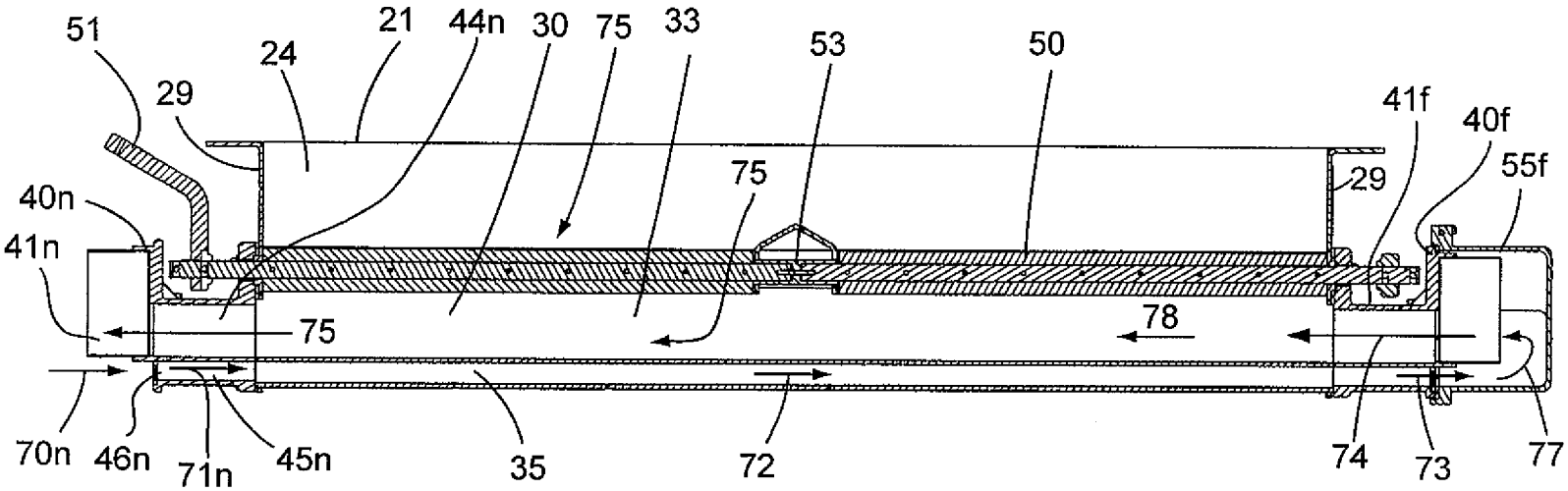
FIG. 7 is a side sectional view of the outlet gate assembly illustrating particular features thereof.

With this configuration, upon removing one of the covers 55 and maintaining the other cover in place as depicted in FIGS. 6-7, the discharge tube 30 and the material flow section 44 and discharge opening of cylindrical outlet tube 41 form a first flow path or discharge conduit 75 (See FIG. 7) through which material within hopper car 10 may be removed. Similarly, with the cover 55 removed, the adjacent air flow section 45 with air flow opening 46 and air flow tube 35 form a second flow path or air flow conduit 72 through which air may flow in the opposite direction. Notably, the cover 55 that remains mounted on the other end adapter 40 connects the covered discharge opening of the discharge tube 30 and the covered air flow opening 46 of the end adapter 40 to form a flow path that begins at the uncovered air flow opening 46 and terminates at the discharge opening of uncovered outlet tube 41.

Covers 55 are configured such that when secured in place on end adapter 40 both the discharge conduit or flow path 75 and air flow path or conduit 72 are isolated from the atmosphere external to the outlet gate assembly 20. However, the interior of each cover 55 defines a communication path designated 77 in FIG. 7, between the covered air flow opening 46 of air flow section 45 and the covered discharge opening of cylindrical outlet tube 41 enclosed by that cover.

With a cover 55 removed from one end, the discharge opening of cylindrical outlet tube 41 and the adjacent air flow opening 46 at a given end of the outlet gate 20 are open to atmosphere. A suitable vacuum hose 60 may be attached over the discharge opening of cylindrical outlet tube 41 to remove the transported material from the hopper car though discharge conduit 75. Air is supplied to the opposite end of the discharge tube 30 through the air flow conduit 72 in which air passes sequentially through uncovered air flow opening 46, air flow section 45 of the end adapter 40 the air flow tube 35 of the outlet gate body 20, the air flow section 45 and air flow opening 46 of the end adapter 40 at the end of the outlet gate with the cover 55 is in place, the interior of the cover 55 at the covered end along path 77 and into the covered discharge opening of discharge tube 30.

The discharge flow conduit and air flow conduit configuration of the embodiment of FIGS. 1 to 7 are best understood in connection with an explanation of the unloading of a hopper car enclosure having an outlet gate assembly 20 of the present disclosure. Unloading of the hopper car 10 proceeds as described below.

A cover 55 is removed from the end adapter 40 at one end of outlet gate 20. That end, to which a vacuum hose 60 is attached for removal of lading is sometimes referred to herein as the "near end." The opposite end of the outlet gate assembly with the cover 55 in place is sometimes referred to as the "far end." In the attached drawings, components are sometimes identified with the suffix "n" to designate the near end and an "f" to designate the far end. Although the near end and far end are depicted in one orientation in the drawings, the outlet gate assembly 20 may be symmetrical and the identification of the near end and the far end components is reversed when unloading the hopper car 10 from the opposite side of the hopper car 10.

After connecting a vacuum hose 60 to the outlet tube 41*n* over the discharge discharge opening at the near end, handle 51 may be rotated to rotate valve 50 to an open position to permit material to flow through the valve opening 27 of outlet gate assembly 20 and into discharge tube 30. Upon applying sufficient negative pressure through the vacuum hose 60 and cylindrical outlet tube 41, material is drawn through discharge opening of cylindrical outlet tube 41 and the vacuum hose. Thus the discharge conduit, or flow path 75 comprises the discharge tube 30, the material flow sections 44*n* and the uncovered cylindrical outlet tube 41*n*. Necessary air flow, to satisfactorily implement product removal as described is provided by the air flow conduit 72 which augments other air flow to the hopper 18 through the associated hatch cover 15.

As best seen in FIG. 7, air (depicted at arrow 70*n*) is drawn into the near end air flow opening 46*n* and passes through the near end air flow section 45*n* of the end adapter 40 (the air depicted at arrow 71*n*). The air passes through the entire length of air flow tube 35, and through air flow section 45*f* and air flow opening 46*f* of the far end adapter 40*f*. With far end cover 55*f* still in place, air passes between air flow opening 46*f* and the discharge opening of cylindrical outlet tube 41 along path 77 defined by the interior of cover 55*f*. As illustrated, air (depicted at arrow 73) enters the cover 55*f* at the far end and is directed by the interior of cover 55 to the far end discharge opening of cylindrical outlet tube 41*f* (depicted by arrow 74). The air then flows into the far end of the discharge tube 30 (arrow 74) and back through the discharge tube (the air depicted at arrow 78) toward the end adapter 40*n* and the material in discharge tube 30 being unloaded. The air that enters the discharge tube 30 mixes with the material (depicted at arrow 75) from the hopper 18 to assist in drawing or removing the material from the discharge tube through the vacuum hose 60.

As a result of the separation of the discharge tube 30 and the air flow tube 35 and the connection of the two through the far end cover 55*f*, material may be removed from a hopper 18 of the enclosure 11 of hopper car 10, avoiding the necessity of removing the far end cover 55 from the far end of outlet gate assembly 20.

As previously described, in the past procedure, when emptying a hopper car 10, the covers 55 from the both sides of the outlet gate assembly 20 were removed. Cover 55*n* was removed to expose the discharge opening of outlet tube 41*n* at the near end. Cover 55*f* was removed to permit access to the discharge opening of the far end of outlet tube 41 for purposes of air entry. In other words, a vacuum hose 60 was connected to the outlet tube 41*n* at the near end of the outlet gate assembly 20 and the far end cover 55*f* was removed from the outlet tube 41*f* on the far end to permit air to flow into the discharge tube 30 on the far end to facilitate material flow out of the near end discharge opening of near end outlet tube 41*n* and into the vacuum hose.

In the arrangement disclosed herein, by providing an air flow that passes sequentially through the near end air flow opening 46*n*, the near end air flow section 45*n*, the air flow tube 35, the far end air flow section 45*f*, the far end air flow opening 46*f*, the interior of cover 55*f*, the discharge opening of far end outlet tube 45*f* into the far end of the discharge tube 30, the desired air supply is provided while only removing the cover 55*n* from the near end of the outlet gate assembly 20. This eliminates the need to gain access to the outlet gate assembly 20 on the opposite or far end of the outlet gate assembly. Access to the far end of the outlet gate assembly 20 often requires climbing over or under railroad cars or walking around a line of railroad cars. By eliminating the need to access the far end of the outlet gate assembly 20 during unloading of the hopper car 10, the unloading process is safer and less time consuming.

Figure 8:
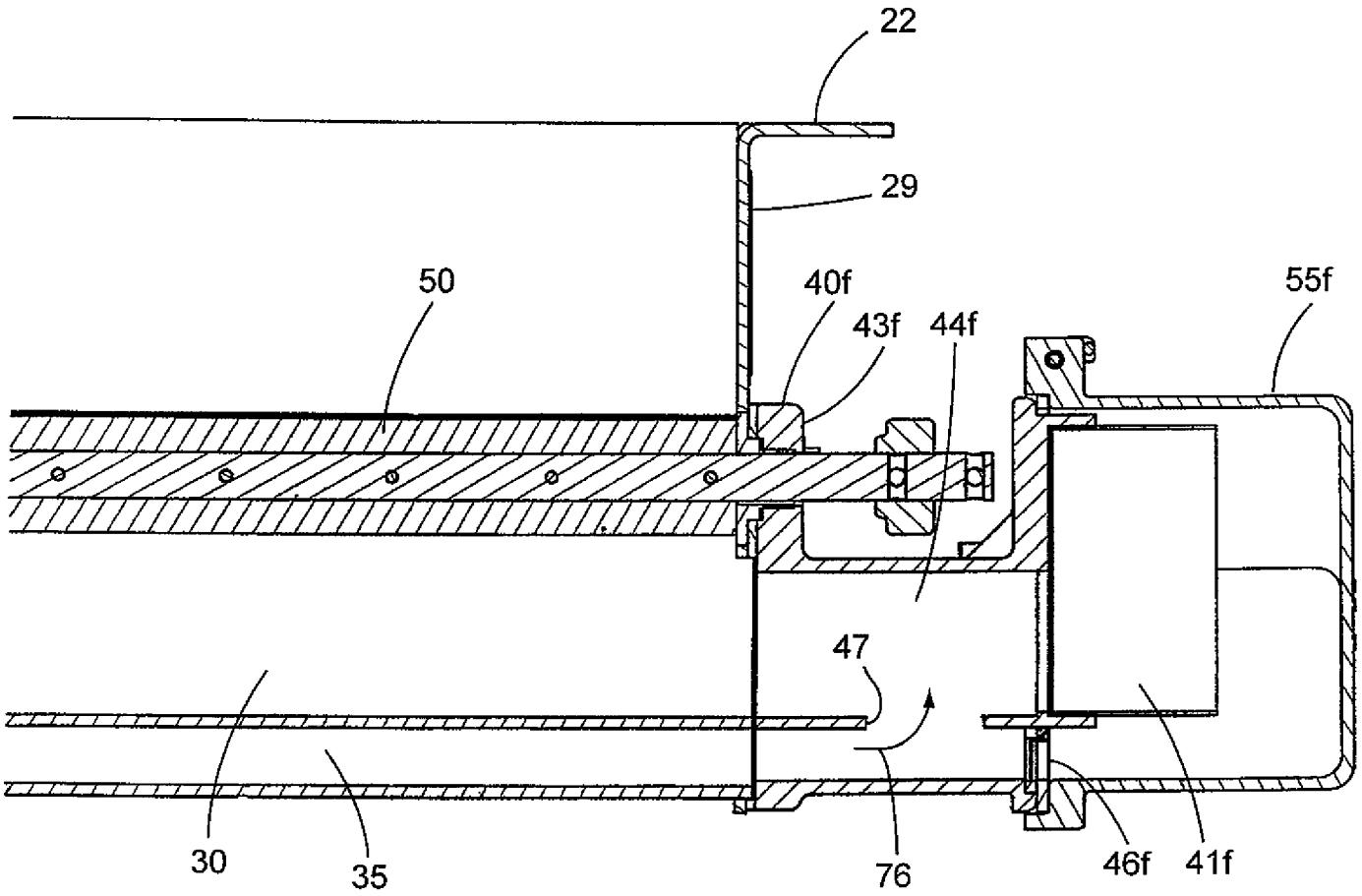
FIG. 8 is a fragmentary sectional view, on an enlarged scale, of a modified form of outlet gate assembly showing details of an end of the discharge tube and end closure cap.

Although the discharge tube 30 and the air flow tube 35 are depicted as concentric components or members, other configurations are contemplated. For example, the discharge tube 30 and air flow tube 35 may be positioned adjacent and/or parallel to each other but need not be concentric. In addition, rather than use the far end cover 55*f* to connect the discharge tube 30 and the air flow tube 35, other manners of connecting the discharge tube and the air flow tube are contemplated. For example, the discharge tube 30 and the air flow tube 35 may be interconnected through an opening 47 in the end adapter 40*f* at the far end as depicted in FIG. 8 so that air (depicted at arrow 76) may pass through the opening.

Notably if the air flow tube 35 is not positioned beneath the discharge tube 30, it may be possible to include openings (not shown) between the discharge tube 30 and the air flow tube 35 to provide the desired air flow without providing an additional path through the end adapter 40*f* located at the far end or the far end cover 55*f*. More specifically, upon opening the valve 50, material will pass through the valve opening 27 and into discharge tube 30. If the air flow tube 35 is positioned beneath the discharge tube 30, any openings between the discharge tube and the air flow tube may fill with material. Accordingly, positioning the air flow tube 35 above or alongside the discharge tube 30 may prevent or reduce the likelihood that any such openings will be filled with material.

Although the configurations described above include a passive air supply, it may be possible to provide pressurized air into the air flow tube 35. In other words, rather than relying upon the vacuum at the discharge tube 30 to pull air into the air flow opening 46, the end adapter 40 may be provided with a fitting (not shown) and a hose (not shown) so that pressurized air may be provided through the end adapter 40 into the air flow tube 35.

Figure 9:
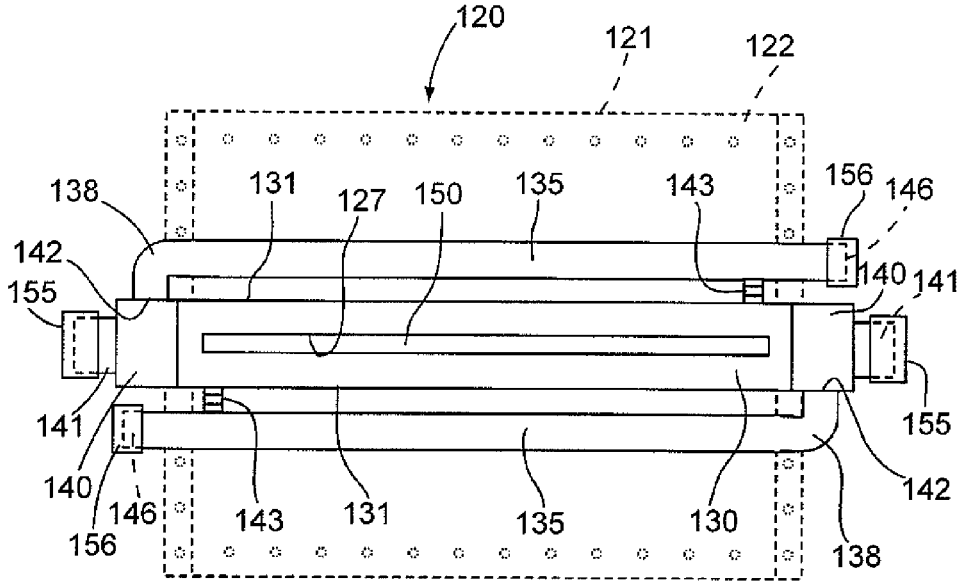
FIG. 9 is a top view of a modified form of outlet gate assembly in accordance with the present disclosure.
Figure 10:
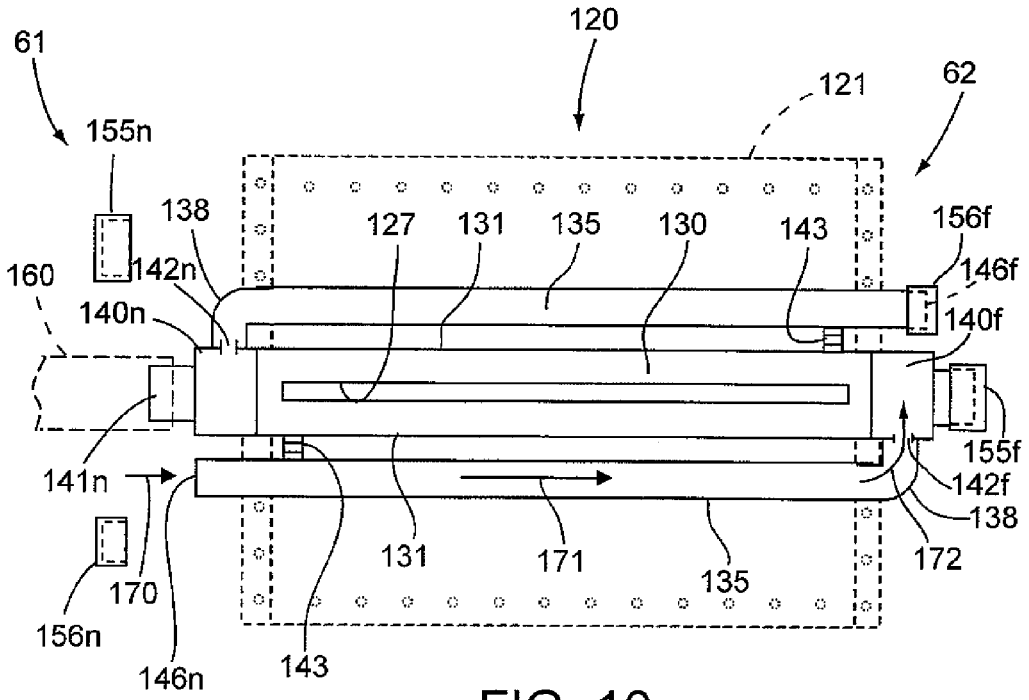
FIG. 10 is a top view of the modified form of outlet gate assembly of FIG. 9, showing the various components in different positions.

Another alternate embodiment of an outlet gate assembly 120 is depicted somewhat schematically in FIGS. 9-10 with body 121 and flange 121 shown in dashed lines. Discharge tube 130 includes end adapters 140 at each end thereof. Each end adapter 140 includes a cylindrical outlet tube 141 defining a discharge opening in communication with discharge tube 130 and over which a vacuum hose 160 (FIG. 10) may be attached. A pair of air flow tubes 135 extend from an air flow opening 136 adjacent a discharge opening of cylindrical outlet tube 141 at one end of the body transversely into fluid communication with the end adapter 140 at the opposite end of the body through an elbow 138. Elbow 138 extends into an opening 142 in the remote end adapter 140. The air flow tubes 140 are positioned generally along opposite sides 131 of the discharge tube 130.

The air flow tubes 135 may have any configuration and do not need to be adjacent or parallel to discharge tube 130. A bracket 143 may extend between the discharge tube 130 and each air flow tube 135 to support the open end 136 of the air flow tube. A discharge cover 155 may be removably mounted on the outlet tube 141 of each end adapter 140. An air flow cover 156 may be removably mounted on the open end 136 of each air flow tube 135.

Referring to FIG. 10, to unload a hopper car using outlet gate assembly 120, the near end discharge cover 155*n* is removed from the near end outlet tube 141*n* and the near end air flow cover 156*n* is removed from the near end air flow opening 146*n* of the air flow tube 135 adjacent the near end outlet tube. A vacuum hose 160 is connected to the near end discharge opening of cylindrical outlet tube 141*n* of the end adapter 140*n* at the near end. A handle (not shown) is rotated to rotate valve 150 to an open position to permit material to flow through the valve opening 127 of the outlet gate assembly 120 and into the discharge tube 130.

Negative pressure is provided through the vacuum hose 160 and the near end outlet tube 141*n* to draw out material from the discharge tube 130 through the discharge opening of near end outlet tube 141 and the vacuum hose 160. Air flow is provided into the far end of the discharge tube 130 by air flow (depicted by arrow 170) that enters the near air flow opening 146 of the air flow tube 135 and travels through the air flow tube 135 (the air depicted by arrow 171), through elbow 138 and opening 142*f* in the far end adapter 140*n* and into the far end of the discharge tube 130 (the air depicted by arrow 172). In this configuration, the discharge tube 130 and near end outlet tube 141 defining a discharge opening connected to vacuum hose 160 acts as a first flow path for discharge of lading. Near end air flow opening 146 and air flow tube 135 with the air flow cover 156*n* removed define an air flow conduit that commences at air flow opening 146 of air flow tube 135 and passes through air flow tube 135, elbow 138 and opening 142 of end adapter 140*f* at the far end of discharge tube 130. The air flows into the far end of discharge tube 130 to augment the supply of air necessary to discharge the lading through the vacuum tube 160.

While each of the structures described herein may be used to create an outlet gate assembly to be mounted on a hopper car 10, the structure depicted in FIGS. 9-10 may be particularly useful to modify or retro-fit existing outlet gate assemblies. To do so, an existing outlet gate assembly may remain generally unchanged other than modification to or replacement of existing end adapters with the end adapters 141 and the addition of the air flow tubes 135.

Figure 11:
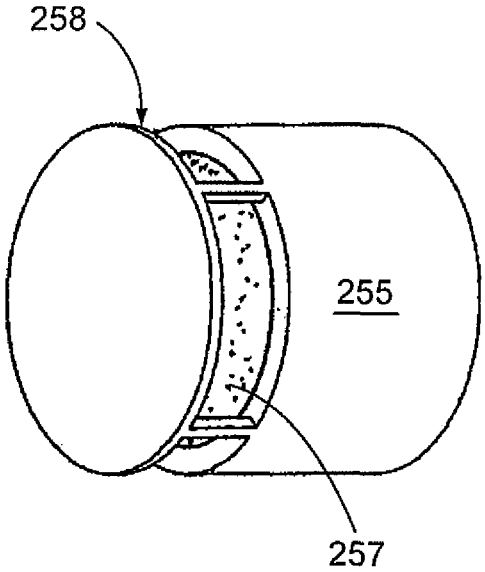
FIG. 11 is a modified form of end cap for a discharge tube of an outlet gate assembly.
Figure 12:
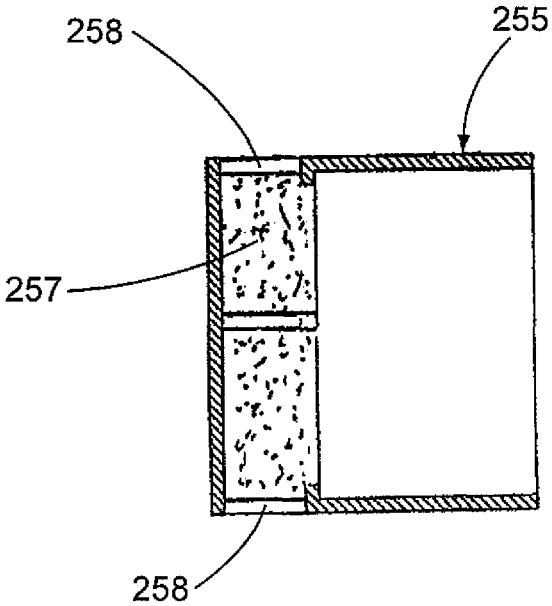
FIG. 12 is a section plan view of the end cap of FIG. 11.

In another contemplated embodiment of an outlet gate in accordance with the present disclosure, it is not necessary to modify the outlet gate as described above. That is, a conventional outlet gate with central discharge tube and conventional end adapters would suffice. no air flow tube is employed. Rather, in this embodiment a conventional outlet gate, Each end adapter would be provided with vented covers 255 shown in FIG. 11 on each of the outlet tubes of end adapter for a conventional discharge tube. Each cover 255 includes a series of vent openings 258 to the surrounding environment. As illustrated, the vent openings 258 are protected by filter media 257 to prevent contamination of the discharging lading.

Discharge of product or material from the discharge tube 30 requires only that one cover 255 be removed from the near end of the outlet gate and a vacuum hose such as hose 60 be connected to the open outlet tube at the near end of the discharge tube by removal of one of the covers 255. Upon opening of the outlet gate discharge valve 50 and initiation of a vacuum in hose 60, air will be drawn into the discharge tube 30 through the cover 255 at the far end of the discharge tube. The openings 258 in cover 255 provide the requisite air supply for the removal of particulate lading through hose 60.

It will be appreciated that the foregoing description provides examples of the disclosed system and technique. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

The invention claimed is:

1. An outlet gate assembly comprising:

a body;

a discharge conduit having opposite ends defining discharge openings, an air flow conduit having an air flow opening adjacent each of said discharge openings and removable covers, each enclosing one of said discharge openings, and the adjacent air flow opening of said air flow conduit, wherein each said cover defines a flow path between said discharge opening and said air flow opening covered thereby.

2. An outlet gate assembly as claimed in claim 1 wherein said discharge conduit comprises an elongate discharge tube within said body defining a valve opening between said discharge tube and said body, a valve member interposed between said body and said discharge tube.

3. An outlet gate assembly as claimed in claim 2 wherein said body includes transverse end walls and said discharge tube extends between said transverse end walls.

4. An outlet gate assembly as claimed in claim 3 wherein said air flow conduit comprises a separate air flow tube extending between said transverse end walls of said body.

5. An outlet gate assembly as claimed in claim 4 wherein said assembly includes an end adapter secured to each said transverse end wall of said body, and each said end adapter includes a cylindrical outlet tube in communication with said discharge tube that defines one of said discharge openings of said discharge conduit.

6. An outlet gate assembly as claimed in claim 5 wherein said end adapters each define an air flow section in communication with said air flow tube and define one of said air flow openings adjacent the discharge opening defined by said cylindrical outlet tube of said end adapter.

7. An outlet gate assembly as claimed in claim 6 wherein removal of one of said covers exposes one of said discharge openings and one of said air flow openings to the surrounding atmosphere.

8. An outlet gate assembly as claimed in claim 1 wherein said air flow conduit includes two separate air flow tubes defining an air flow opening in communication with said discharge conduit at a location remote from said air flow opening of said tube of said air flow conduit.

9. A method of discharging material from an outlet gate assembly for a hopper car, having a body;

a discharge conduit having opposite ends defining discharge openings, an air flow conduit having an air flow opening adjacent each of said discharge openings and removable covers, each enclosing one of said discharge openings, and the adjacent air flow opening of said air flow conduit, wherein each said cover defines a flow path between said discharge opening and said air flow opening covered thereby, and wherein said discharge conduit comprises an elongate discharge tube within said body defining a valve opening between said discharge tube and said body, and a valve member interposed between said body and said discharge tube, and wherein removal of one of said covers exposes one of said discharge openings and one of said air flow openings to the surrounding atmosphere, said method comprising:

removing one of said removable covers enclosing one of said discharge openings and the adjacent air flow opening and maintaining said other cover in place, closing said other discharge opening and the adjacent air flow opening and providing a flow path therebetween, attaching a vacuum hose to said uncovered discharge opening, opening said valve member interposed between said body and said discharge tube, applying a vacuum to said vacuum hose.

10. The method of claim 9 wherein said body includes transverse end walls and said discharge tube extends between said transverse end walls of said body, said air flow conduit comprises a separate air flow tube extending between said transverse end walls of said body, said assembly includes an end adapter secured to each said transverse end wall of said body, and each said end adapter includes a cylindrical outlet tube in communication with said discharge tube and defines one of said discharge openings of said discharge conduit, said end adapters each define an air flow section in communication with said air flow tube and define one of said air flow openings adjacent the discharge opening defined by said cylindrical outlet tube of said end adapter, said method further comprising:

attaching a vacuum hose to one of the cylindrical outlet tubes.

11. An outlet gate assembly of a hopper car comprising:

a body having a first side configured to be positioned on a first side of the hopper car and second side configured to be positioned a second, opposite side of the hopper car;

a discharge conduit on the body, the discharge conduit having a first end generally adjacent the first side of the body and a second end generally adjacent the second side of the body, the discharge conduit being configured to pass material through each of the first end and the second end;

an air flow conduit having closable ends open at the ends of the discharge conduit; and removable closures, closing each end of said discharge conduit and said ends of said air flow conduit, wherein each said closure defines a flow path between said discharge opening and said air flow opening covered thereby.

12. An outlet gate assembly of a hopper car comprising:

a body for mounting on the hopper car, the body having a first side and a second side, the first side being configured to be positioned on a first side of the hopper car and the second side being configured to be positioned on a second, opposite side of the hopper car;

a discharge conduit on the body, the discharge conduit having a first end generally adjacent the first side of the body and a second end generally adjacent the second side of the body, the discharge conduit being configured to pass material through each of the first end and the second end; and an air flow conduit associated with the body and the discharge conduit, upon opening the first end of the discharge conduit and the closing the second end of discharge conduit, the air flow conduit including a first air flow path extending generally from the first side of the body generally towards the second side of the body and being in fluid communication with the discharge conduit generally adjacent the second end of the discharge conduit, and upon opening the second end of the discharge conduit and the closing the first end of discharge conduit, the air flow conduit including a second air flow path extending generally from the second side of the body generally towards the first side of the body and being in fluid communication with the discharge conduit generally adjacent the first end of the discharge conduit.

13. A method of discharging material from an outlet gate assembly for a hopper car, having a body;

a discharge conduit having opposite ends defining discharge openings, and said discharge conduit defining a valve opening between said discharge conduit and said body, and a valve member interposed between said body and said discharge conduit, and removable covers each enclosing one of the discharge openings of the outlet gate, each said cover including a body having at least one vent opening to permit air flow from the surrounding atmosphere into the discharge conduit, said method comprising:

removing one of said removable covers enclosing one of said discharge openings and maintaining said other cover in place, attaching a vacuum hose to said uncovered discharge opening, opening said valve member interposed between said body of said outlet gate assembly and said discharge conduit, applying a vacuum to said vacuum hose.

* * * * *